United States Patent [19]

Jacobs, Jr.

[11] 4,315,235

[45] Feb. 9, 1982

[54] COMPOSITE FUSIBLE ELEMENT FOR ELECTRIC CURRENT-LIMITING FUSES

[76] Inventor: Philip C. Jacobs, Jr., 53 Waldon St., Newtonville, Mass. 02160

[21] Appl. No.: 173,942

[22] Filed: Jul. 31, 1980

[51] Int. Cl.[3] ..... H01H 85/08; H01H 85/10

[52] U.S. Cl. ..... 337/296; 337/161; 337/162; 337/295

[58] Field of Search ..... 337/159, 160, 161, 162, 337/290, 292, 293, 295, 296

[56] References Cited

U.S. PATENT DOCUMENTS

| | | | |
|---|---|---|---|
| 2,781,434 | 2/1957 | Swain | 337/159 |
| 2,809,257 | 10/1957 | Swain | 337/159 |
| 3,543,209 | 11/1970 | Kozacka | 337/159 |

*Primary Examiner*—Harold Broome
*Attorney, Agent, or Firm*—Erwin Salzer

[57] ABSTRACT

A composite fusible element of silver and copper includes an inlay of silver and a base formed by a thicker strip of copper than the inlay of silver. The strip of copper is severed by a pair of juxtaposed incisions, so that the entire current is carried at this particular point only by the strip of silver. Moreover, the incisions penetrate into the strip of silver, producing in it a point of reduced cross-section. The strip of copper is preferably provided with a concave groove. The strip of silver is preferably convex and fits into the concave groove of the strip of copper. The composite fusible element may include several parallel strips of silver in a joint base of copper.

3 Claims, 6 Drawing Figures

FIG. 1
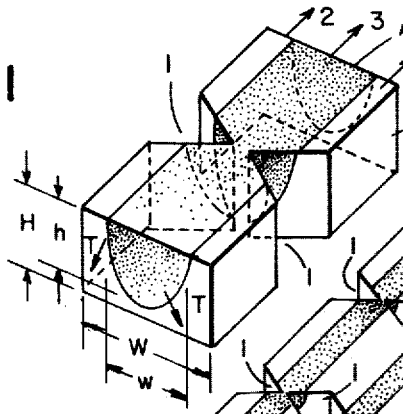
FIG. 2
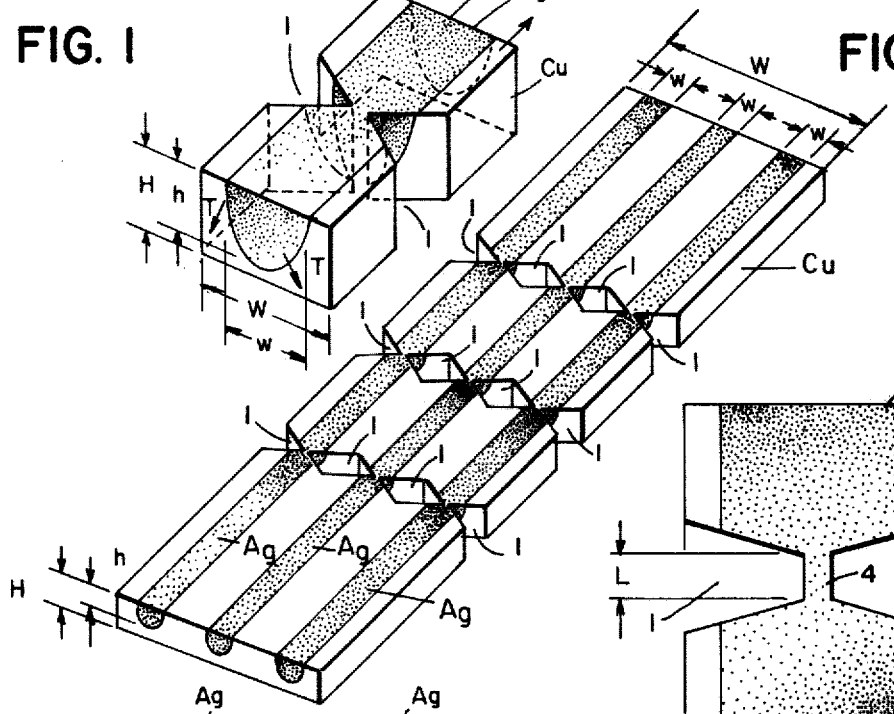
FIG. 3
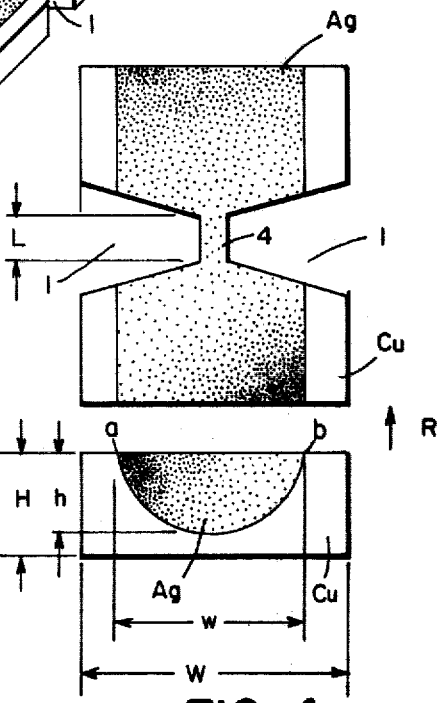
FIG. 4
FIG. 5
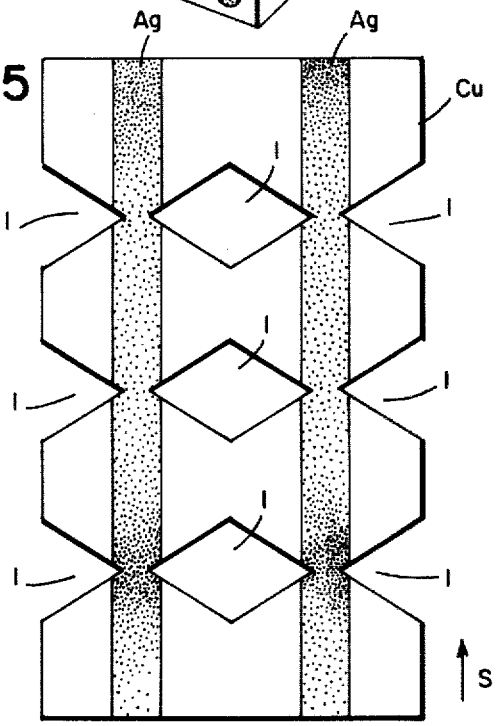
FIG. 6
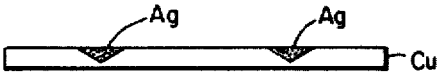

COMPOSITE FUSIBLE ELEMENT FOR ELECTRIC CURRENT-LIMITING FUSES

BACKGROUND OF THE INVENTION

The closest prior art known are U.S. Pat. No. 2,781,343; 02/12/57 to K. W. Swain for CURRENT-LIMITING FUSE COMPRISING FUSE LINKS OF SILVER AND COPPER, and U.S. Pat. No. 2,809,257 to K. W. Swain for COMPOSITE FUSE LINKS OF SILVER AND COPPER. These two patents solve the problem of reducing the fusing and vaporization $I^2 \cdot t$ value of the fusible element in terms of $(Amps \cdot /cm^2)^2$-sec. without resorting to a fusible element which is all of silver. The present invention provides a fusible element having a greater current-carrying capacity than the fusible elements disclosed in the above referred-to patents to Swain on account of more effective cooling means than those disclosed by Swain.

According to the present invention, the composite fusible element comprises a strip of silver having a predetermined thickness and a strip of copper having a thickness in excess of said predetermined thickness. The strip of copper has a groove and the strip of silver is placed into said groove and forms an inlay in said strip of copper. In other words, the strip of copper is wrapped around the strip of silver, such greatly increasing the interface between both metals in comparison to Swain.

As in Swain, a pair of juxtaposed incisions sever entirely said strip of copper and reduce the cross-section of said strip of silver at the point where said pair of incisions is located.

An interface is, however, formed where said strip of silver and said strip of copper meet. The cross-section of said interface has a length larger than twice the thickness of said strip of silver. Both in Swain and in applicant's structure the copper parts of the fusible element form cooling fins for cooling a strip of silver. The inlay of a strip of silver in a base of copper results, however, in a much larger interface between silver and copper than in Swain because in Swain the area of the two interfaces between silver and copper is roughly only equal to the narrow edges where the two metals meet, while in the structure according to the present invention the interface between silver and copper also includes the relatively wide bottom surface of the strip of silver and the relatively large bottom surface of the groove in the strip of copper.

Thus there will be a large heat-flow from the silver insert to the copper base, and from there to the pulverulent arc-extinguishing filler normally surrounding the copper base.

SUMMARY OF THE INVENTION

As in Swain, a composite fusible element according to this invention for electric current-limiting fuses includes a strip of silver having lateral cooling fins of copper. Said cooling fins have juxtaposed incisions entirely severing said cooling fins of copper and reducing the cross-section of said strip of silver at the point where said incisions are located.

According to the present invention the cooling fins are formed by an integral strip of copper having a thickness exceeding the thickness of said strip of silver, said strip of copper having a groove into which said strip of silver is fitted so as to form an inlay in said strip of copper. This establishes a large interface between said strip of silver and said strip of copper resulting in a large heat flow from said strip of silver to said strip of copper when said fusible element is carrying current.

BRIEF DESCRIPTION OF THE DRAWINGS

FIG. 1 is an isometric view of a fusible element according to this invention whose point of reduced cross-section, or neck, is a point heat source;

FIG. 2 is an isometric view of a fusible element according to this invention whose points of reduced cross-section, or necks, are point heat sources and which has a plurality of silver inserts to increase the current-carrying capacity, or current-rating, thereof;

FIG. 3 is a top-plan view of the structure shown in FIG. 1, except that the point of reduced cross-section has a predetermined length, i.e. is not adapted to form a point heat source;

FIG. 4 is an end view of the fusible element of FIG. 3 seen in the direction of the arrow R of FIG. 3;

FIG. 5 is a top plan view of a modification of the structure shown in FIG. 2; and FIG. 6 is an end view of the structure shown in FIG. 6 as seen in the direction of the arrow S in FIG. 5.

DESCRIPTION OF PREFERRED EMBODIMENTS

Referring now to FIG. 1 of the drawings, this figure shows an inlay of a strip of Ag in a strip of Cu. The width W of the strip of Cu exceeds the width w of the strip Ag. The thickness H of the strip of Cu exceeds the thickness h of the strip Ag.

Reference numeral 1 has been applied to indicate a pair of juxtaposed incisions formed in strips Cu and Ag. The removal of Cu and Ag effected by these incisions results in a complete severance of the current path through the strip Cu indicated by an arrow 2 and restriction of the current-path through the strip Ag indicated by an arrow 3. The strip Ag is convex at its interface with the strip Cu and the strip Cu is concave at its interface with strip Ag. The engaging surfaces of strips Ag and Cu conform, or are congruent, except at the juxtaposed points of incisions, or material removal, 1. It will be apparent that this geometry of strips Ag and Cu results in a relatively large interface between strips Ag and Cu conducive to a large heat flow from strip Ag to strip Cu. This heat flow has been indicated by arrows T. It is larger than in prior art fusible elements because it occurs through three rather than two surfaces, and because the width w of the groove in Cu receiving the strip Ag is in practice considerably larger than the thickness H of copper strip Cu.

In FIGS. 2–6 the same reference characters as in FIG. 1 have been applied to indicate like parts. Hence, FIGS. 2–6 will only be described to the extent that they differ significantly from FIG. 1.

According to FIG. 2 an inlay is formed by three strips of Ag, each having the width w, and by the strip Cu having the width W. The strips Ag form parallel current paths. A plurality of lines of incisions 1 severs entirely the strip of copper Cu and reduces the cross-section of each of said plurality of strips of silver Ag at serially arranged locations thereof. The thickness H of said strip of copper Cu is in excess of the thickness h of said strip of silver Ag. As explained above, this increases the interface compared to prior designs between the two strips and the length of of its cross-section, i.e. the length of line a–b in FIG. 4.

In the structure of FIGS. 3 and 4 a strip of silver Ag is embedded in a strip of copper Cu. The thickness of the strip of copper Cu has been indicated by H and the thickness of the strip of silver Ag has been indicated by h. The width of the strip of copper Cu has been indicated by W and the width of the strip of silver Ag has been indicated by w. Strips Cu and Ag have an interface which is curvilinear in cross-section to establish a large interface between the two metals. The materials of which strips Ag and Cu are made is removed, or punched out, so as to establish incisions at point 1. The point of narrowest cross-section of strip Ag has been indicated by reference character 4 and it is apparent that this point is not designed to form a point heat source when carrying current, but has a predetermined length indicated at L.

FIGS. 5 and 6 show two strips of silver Ag forming inlays in the strip of copper Cu. The points where the copper strip Cu and the silver strip Ag were punched out, or blanked out, have been indicated by reference numeral 1. The structure of FIGS. 5 and 6 differs from that shown in FIG. 2 mainly on account of the fact that the interfaces between strips Ag and Cu are not curvilinear in cross-section, but formed by straight lines.

It will be apparent that the structure shown in FIGS. 5 and 6 includes a straight and relatively wide strip of copper Cu having a predetermined thickness and defining a pair of straight grooves. The depth of each of said pair of grooves is less than the thickness of said strip of copper Cu, so that their side and bottom walls are of copper only. Said pair of grooves are spaced from the center and from the edges of said strip of copper Cu. A pair of inlays Ag is arranged in each of said pair of grooves. The structure shown in FIGS. 5 and 6 includes two kinds of incisions to both of which reference numeral 1 has been applied. A first kind of incision 1 is arranged between inlays Ag of silver and sever entirely the portion of the strip of copper situated between the inlays Ag and reduce the cross-section of the pair of inlays Ag of silver at the point where the said first incisions 1 are located. A second kind of incisions include incisions 1 aligned with said first kind of incisions, arranged at the lateral edges of said strip of copper Cu and entirely severing the portions of said strip of copper Cu situated outward of the pair of inlays Ag and reducing the cross-section of said pair of inlays of silver Ag at the points where said second kind of incisions are located.

For reasons of greater clarity the proportions of FIGS. 1-6 are not the actual proportions of fusible elements but have been chosen to better illustrate the design according to the present invention. Briefly stated, any fusible element as used in the art is substantially in the form of a piece of sheet metal or, in other words, its thickness has been exagerated in FIGS. 1-6. To be more specific, the thickness H of fusible strip of copper Cu actually may be in the order of 0.01", or less.

Fuse structures wherein the fusible element according to the present invention may be used are shown in the above referred-to patents to K. W. Swain.

I claim as my invention:

1. A composite fusible element for current-limiting fuses comprising (a) an elongated straight strip of silver;

(b) a pair of cooling fins for said strip of silver, said pair of cooling fins being of copper and each being arranged to oppsite sides of said strip of silver;

(c) a pair of juxtaposed incisions in said strip of silver and in said pair of cooling fins entirely severing said pair of cooling fins and extending into said strip of silver to both sides thereof and thereby reducing the cross-section of said strip of silver;

(d) said pair of cooling fins being formed by a unitary strip of copper defining a groove having side walls and bottom walls which are only of copper; and (e) said strip of silver having the same geometrical configuration as said groove and forming an inlay of said groove resulting in a large heat flow away from said strip of silver and toward said pair of cooling find when said fusible element is carrying current.

2. A composite fusible element as specified in claim 1 wherein the cross-section of the interface between said strip of silver and said strip of copper has a curvilinear outline.

3. A composite fusible element for current-limiting fuses comprising (a) a plurality of elongated straight parallel and relatively narrow strips of silver;

(b) an elongated straight and relatively wide strip of copper, said strip of copper having a plurality of parallel grooves, each of said plurality of grooves comprising side and bottom walls which are of copper only;

(c) each of said plurality of strips of silver being inserted into one of said plurality of grooves having the identical geometrical configuration as said one of said plurality of grooves, and forming an inlay of said strip of copper; and (d) a plurality of perforations in said plurality of strips of silver and in said strip of copper aligned in a direction transversely to said plurality of strips of silver, said plurality of perforations jointly severing said strip of copper and reducing the cross-section of each of said plurality of strips of silver.

* * * * *